US005507923A

United States Patent [19]

Stouse et al.

[11] Patent Number: 5,507,923

[45] Date of Patent: Apr. 16, 1996

[54] METHOD AND APPARATUS FOR ELECTROLYTIC POLISHING OF TUBULAR PRODUCTS

[76] Inventors: Henry J. Stouse, 11714 Durrette Dr., Houston, Tex. 77024; Mark D. Stouse, 254 Mayerling Dr., Houston, Tex. 77024; R. Keith Raney, 16210 Cypress Valley, Cypress, Tex. 77429

[21] Appl. No.: 151,070

[22] Filed: Nov. 9, 1993

[51] Int. Cl.[6] ..... C25F 3/16; C25F 7/00; C25F 3/24

[52] U.S. Cl. ..... 205/679; 204/224 M; 204/225; 204/272; 204/275; 204/280; 205/680; 205/681; 205/641; 205/645

[58] Field of Search ..... 204/224 M, 237, 204/272, 225, 228, 275, 280, 129.1, 224 R

[56] References Cited

U.S. PATENT DOCUMENTS

| | | | |
|---|---|---|---|
| 908,937 | 1/1909 | Bayliss et al. | 204/146 |
| 1,050,678 | 1/1913 | Moreno | 166/278 |
| 2,561,222 | 7/1951 | Passal | 204/146 |
| 2,764,540 | 9/1956 | Farin et al. | 204/140.5 |
| 2,848,401 | 8/1958 | Hartley | 204/143 |
| 2,970,950 | 2/1961 | Bahmann | 204/272 X |
| 3,429,787 | 2/1969 | Weinreich | 204/272 X |
| 4,369,101 | 1/1983 | Wolff et al. | 204/272 X |
| 4,601,802 | 7/1986 | Grimes et al. | 204/272 X |
| 4,690,737 | 9/1987 | Vishnitsky | 204/129.7 |
| 4,710,280 | 12/1987 | Brilmyer et al. | 204/146 |
| 4,772,367 | 9/1988 | Menzel et al. | 204/129.5 |
| 4,826,582 | 5/1989 | Lavalerie et al. | 204/272 X |
| 4,849,084 | 7/1989 | Vouzellaud | 204/272 X |
| 5,004,529 | 4/1991 | Vishnitsky | 204/272 X |

OTHER PUBLICATIONS

Delstar Electropolish, Electropolishing, A User's Guide To Applications, Quality Standards and Specifications, Revised Jun., 1992.

*Primary Examiner*—Donald R. Valentine
*Attorney, Agent, or Firm*—Fish & Richardson

[57] ABSTRACT

An apparatus is provided for electrolytically polishing the inside surface of tubular products such as rifled stock, or fiream or artillery barrels. The apparatus comprises a first and second reservoir in fluid communication through the tubular product with an electrolyte flow system. A cathode head is provided that is displaced from one reservoir to the other in the presence of flowing electrolyte and at a current density of between 1 and 5 amp-min/sq. in. A method of electrolytically polishing tubular products is also provided.

29 Claims, 6 Drawing Sheets

METHOD AND APPARATUS FOR ELECTROLYTIC POLISHING OF TUBULAR PRODUCTS

FIELD OF THE INVENTION

The present invention relates generally to a method and apparatus for electrolytically polishing the inside surface of a tubular product, and more specifically relates to a method and apparatus for electrolytically polishing the inside surface of a firearm or artillery barrel.

DESCRIPTION OF RELATED ART

It is well known that ion transfer occurs between the positively charged anode and the negatively charged cathode of an electrolytic cell. This phenomenon has given rise to the electrostripping industry, the electropolishing industry, and the electromachining industry.

For example, U.S. Pat. No. 4,710,280, entitled "Method and Apparatus for Electrochemically Cleaning Gun Bores and the Like" is directed to the removal of non-ferrous metal fouling from ferrous gun barrels by the use of a low voltage dc potential applied between the ferrous base metal of the fire arm to be cleaned and an auxiliary electrode that is inserted into the bore.

U.S. Pat. No. 4,772,367, entitled "Apparatus for and a Method of Electrochemically Polishing Pipe Inside Surfaces," is directed to electrochemically polishing and/or pickling the inner surfaces of pipes by moving a polishing head with a dielectric outer wall through the pipe.

U.S. Pat. No. 4,690,737, entitled "Electrochemical Rifling of Gun Barrels," is directed to the electrolytic machining of rifling in a gun barrel.

The present invention is directed to an improved method and apparatus for electrolytically polishing the inside surface of a tubular product, such as a firearm or artillery barrel, without adversely affecting rifling or other desirable surface features of the tubular product.

SUMMARY OF THE INVENTION

In one aspect of the present invention, an apparatus is provided that comprises a first reservoir and a second reservoir that is spaced apart from the first reservoir. The second reservoir is in fluid communication with the first reservoir when a tubular product to be polished is placed between the reservoirs. A cathode head that comprises a conductor portion and a non-conductor portion, that is adapted to reside in the first reservoir and the second reservoir, and that is further adapted to travel along an inside surface of the tubular product with only the non-conductor portion engaging the tubular product is provided. A cathode rod comprising a conductor portion and a non-conductor portion with each portion extending substantially the length of the rod is adapted for mating engagement with the conductor portion of the cathode head. An electrolyte supply system for supplying an electrolyte at a predetermined flow rate is also provided. The system supplies electrolyte to the first reservoir and retrieves electrolyte from the second reservoir. A drive assembly displaces the cathode head from either of the first or second reservoirs and along the inside surface of the tubular product at a predetermined rate and a power supply establishes an electric potential between the cathode head and the tubular product so that ionic transfer is accomplished between the inside surface of the tubular product in the presence of flowing electrolyte.

In another aspect of the present invention, a programmable controller is provided to monitor and control the various parameters and systems.

In still another aspect of the present invention, a cathode head for electrolytic polishing is provided that comprises a central portion comprising an electrically conductive substantially cylindrical rod twisted about itself. A plurality of non-conductive spacers emanate substantially radially from the central portion. The spacers are arranged such that fluid flow over the central portion is not substantially restricted. An electrical connection is provided into which the central portion terminates. The connection is adapted to withstand stresses associated with pushing or pulling the cathode head and is adapted to withstand conduction of electricity associated with electrolytic polishing.

In yet another aspect of the present invention, a method for electrolytically polishing an inside surface of a tubular product is provided, which comprises the steps of parking a cathode head in a first reservoir that is located adjacent one end of the tubular product. A second reservoir is provided that is located adjacent another end of the tubular product. The first reservoir, the tubular product, and the second reservoir are in fluid communication. An electrolyte is flowed through the first reservoir, the tubular product and the second reservoir, and over the cathode head. An electric potential between the tubular product and the cathode head is established and the cathode head is displaced from the first reservoir along the length of said tubular product. Ionic displacement between the tubular product and the cathode head is produced.

BRIEF DESCRIPTION OF THE DRAWINGS

Other objects and advantages of the present invention will become apparent upon reading the following detailed description with reference to the drawings in which.

DESCRIPTION OF THE PREFERRED EMBODIMENTS

Figure 1:
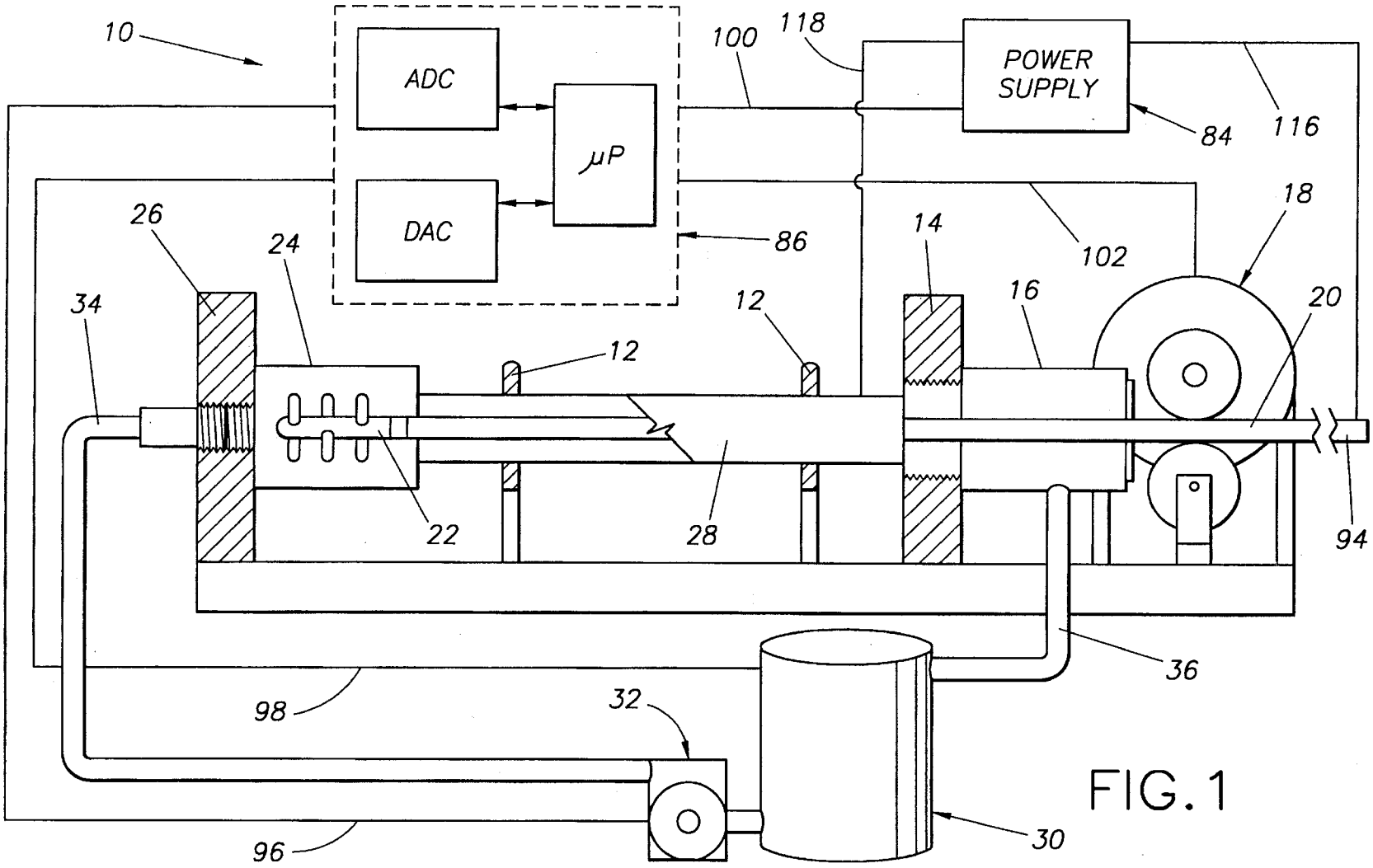
FIG. 1 illustrates a diagrammatic schematic in partial cross-section of the present invention.

A preferred embodiment of the present invention is shown in FIG. 1. Reference numeral 10 indicates a computerized electrolytic polishing apparatus for polishing the inside surface of tubular products. The apparatus 10 comprises tubular product supports 12, a discharge seal block 14, a discharge reservoir 16, a cathode drive assembly 18, a cathode rod 20, a cathode head 22, an entrance reservoir 24, and an entrance seal block 26. Also shown in FIG. 1 is a tubular product 28.

FIG. 1 also shows an electrolyte reservoir 30, an electrolyte pump 32, a supply line 34, and a return line 36. The preferred embodiment of the present invention also comprises a power supply 84 and a controller 86.

As a general overview of the present invention, after the tubular product 28 has been installed in the apparatus 10, the cathode head 22 is positioned in the entrance reservoir 24. An electrolyte (not shown) that is selected in accordance with well-known electrochemistry principles is circulated into the entrance reservoir 24, past the cathode head 22, through the tubular product 28 and the discharge reservoir 16. As will be discussed in more detail below, the controller 86 can be used to monitor and control various parameters such as the flow rate of the electrolyte, the temperature of the electrolyte, and the metal content of the electrolyte.

The power supply 84 is energized to maintain the tubular product at a positive potential relative to the cathode head. The cathode drive assembly 18 causes the cathode head 22 to travel through the tubular product 28 at a specified rate. The controller 86 can be used to monitor and control the voltage and current output of the power supply 84 and to monitor and control the cathode drive assembly 18. In this manner, the inside surface of the tubular product 28 can be electrolytically polished with the apparatus 10.

Figure 2:
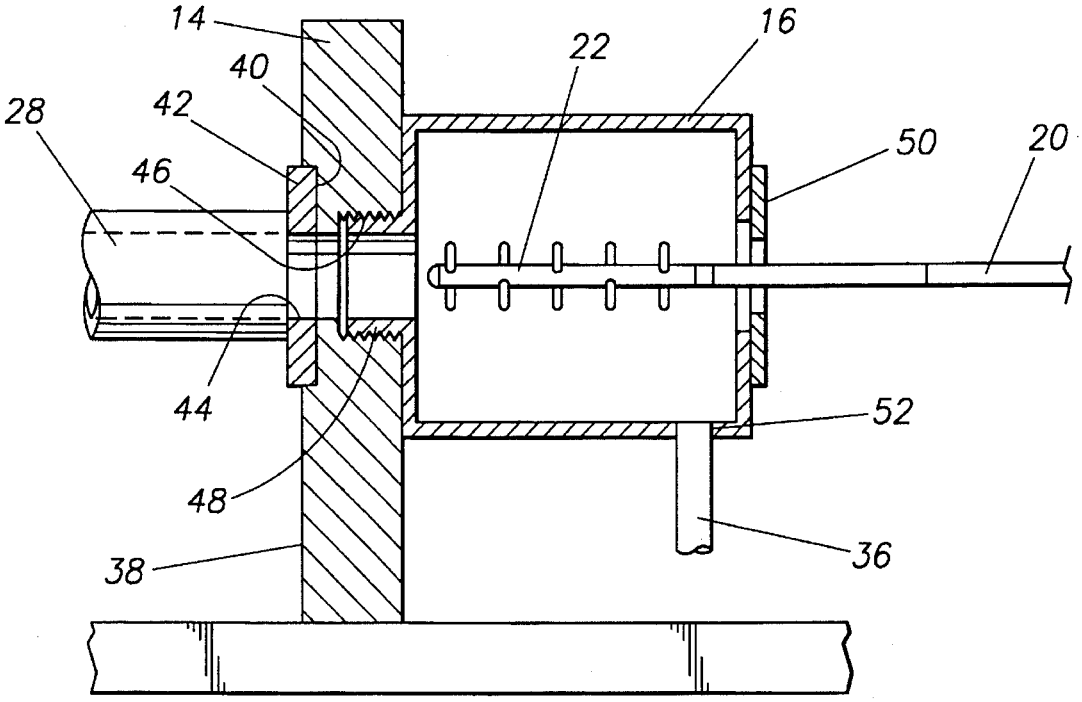
FIG. 2 illustrates a cross-sectional view of the discharge seal block of the preferred embodiment.

Referring now to FIG. 2, a more detailed view of the discharge seal block 14 is shown. The discharge seal block 14, in the preferred embodiment, comprises a seal face 38 having a recessed sealing surface 40. Preferably, the recessed seal surface 40 is circular in shape and is adapted to a receive discharge seal 42. The discharge seal 42 is preferably washer-shaped and made from material that will form a fluid-tight compressive seal between the recessed sealing surface 40 and the tubular member 28. The discharge seal 42 may be fabricated from polytetrafluoroethylene (PTFE), phenolic, rubber, or other non-conductive material resistant to the electrolyte being used with the electrolytic polishing apparatus 10. Alternatively, the discharge seal 42 may be a relatively soft conductor such as copper that will form a fluid-fight seal between the recessed sealing surface 40 and the tubular member 28. The use of a conductive seal allows the electrolytic reaction to commence while the cathode head 22 is still in the entrance reservoir 24. The sealing surface 40 has an opening 44 formed therein. The opening 44 is of sufficient diameter to allow the cathode head 22 to pass therethrough. Extending through the discharge seal block 14 is a threaded connection 46. The threaded connection can utilize straight threads or preferably self-sealing tapered threads.

Also shown in FIG. 2 is the discharge reservoir 16. The discharge reservoir 16 comprises a substantially cylindrical housing with a threaded connection 48 at one end. The inside diameter surface of the threaded connection 48 is preferably greater than the maximum outside diameter of the cathode head 22 so that the cathode head 22 may pass therethrough. At the end opposite the threaded connection 48, the discharge reservoir 16 has a cathode rod seal 50. The cathode rod seal 50 is collinear with the center line of the threaded connection 48, the threaded connection 46, and the recessed sealing surface 40. Preferably, the cathode rod seal 50 comprises a replaceable elastomeric seal such as an "O" ring. The discharge reservoir 16 also comprises an electrolyte return connection 52 to which the electrolyte return line 36 may be coupled in fluid-tight communication. As can be seen by referring again to FIG. 1, the discharge reservoir 16 serves to house the cathode head 22 when the cathode rod 20 is in the fully retracted position.

Figure 3:
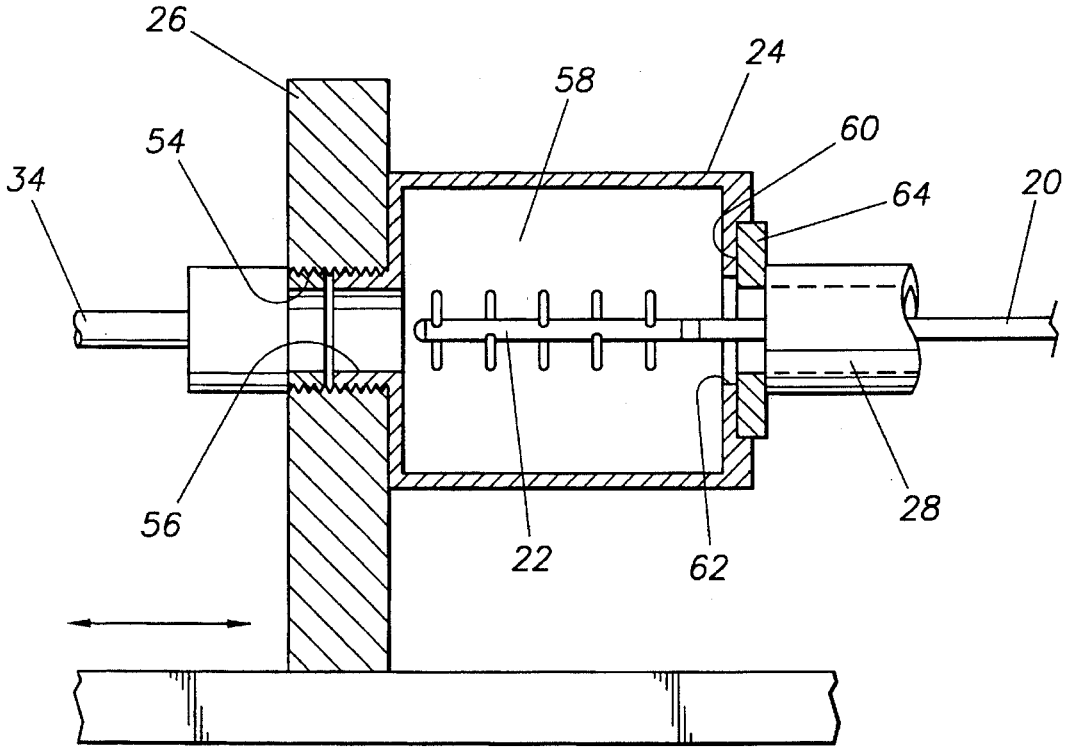
FIG. 3 illustrates a cross-sectional view of the entrance seal block of the preferred embodiment.

Referring now to FIG. 3, the entrance seal block 26, the entrance reservoir 24 and the supply line 34 are shown in greater detail. The entrance seal block 26 is shown to have an internal threaded connection 54 extending therethrough. The threaded connection 56 integral with the entrance reservoir 24 is adapted to engage the internal threaded connections 54 in a fluid-tight sealing engagement. The internal threaded connection 54 is also adapted to engage the electrolyte supply line 34 in a fluid-tight sealing engagement. The entrance reservoir 24 comprises a substantially cylindrical housing having an internal chamber 58 of dimensions sufficient to house the cathode head 22. The end of the entrance reservoir 24 opposite the threaded connection 56 has a sealing surface 60 that is substantially circular in shape and has an opening 62 therein. The opening 62 is of sufficient dimension to allow the cathode head 22 to pass therethrough. Also shown in FIG. 3 is an entrance seal 64. The entrance seal 64 is similar to the discharge seal 42 in that it is substantially washer-shaped and can be fabricated from non-conductive sealing material or conductive sealing material. As shown in FIG. 1, the entrance reservoir 24 houses the cathode head 22 when the cathode rod 20 is in its fully extended position.

Figure 4:
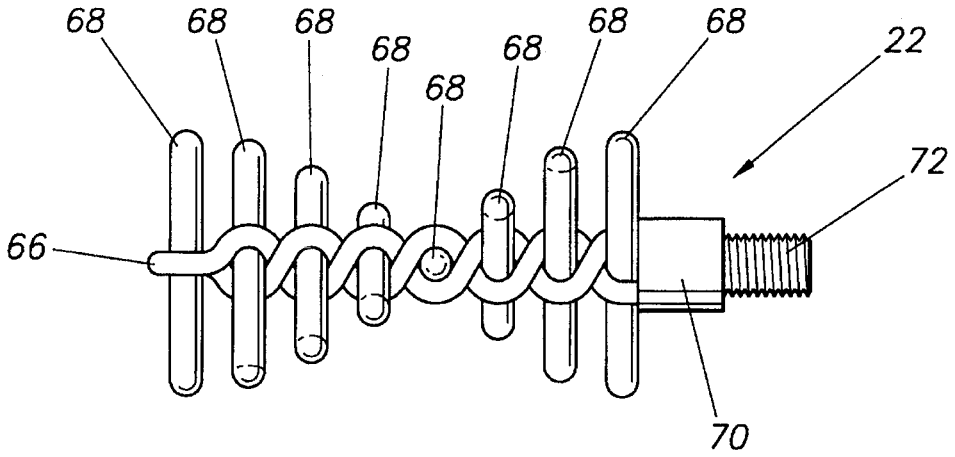
FIG. 4 illustrates a plan view of the cathode head of the preferred embodiment.
Figure 5:
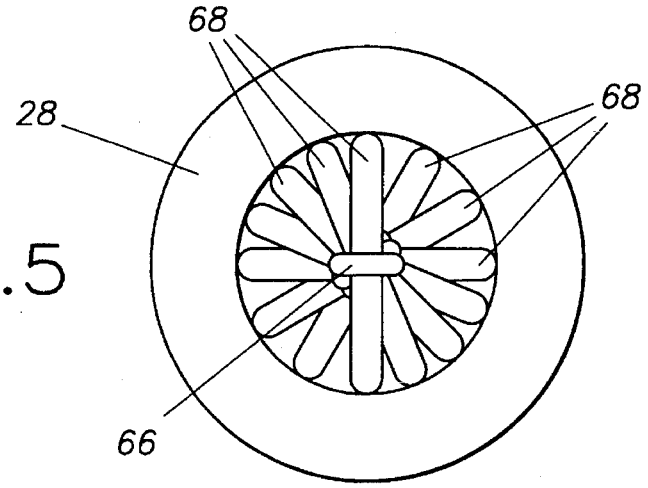
FIG. 5 illustrates an end view of a tubular product with the cathode head of FIG. 4.

Referring now to FIGS. 4 and 5, FIG. 4 details a preferred embodiment of the cathode head 22. The cathode head 22 is shown to be comprised of a cathode 66 that in the preferred embodiment is a cylindrical metallic conductor twisted about itself. The cathode 66, in the preferred embodiment, is fabricated from copper wire commonly used as an electrical conductor. Any number of other conductors such as stainless steel, carbon steel (e.g., AISI 10XX series), alloy steel (e.g., AISI 41XX or 43XX series), aluminum, or graphite may be used. Also, as the length of the cathode 66 increases, strength of the cathode material may become important. In such situations, a Beryllium-Copper alloy such as ASTM A172 may be used in place of weaker copper wire.

Interspersed within the voids formed by the twisted cathode 66 are non-conductive spacers 68. Preferably, the non-conductive spacers 68 are fabricated from glass-fried polytetrafluoroethylene (PTFE). Glass-filled PTFE is preferred over PTFE alone because of its increased strength and machinability. As also shown in FIG. 4, the non-conductive spacers 68 are positioned so that they follow a helical pattern along the length of the cathode 66. The cathode 66 terminates in a cathode base 70 that has cathode threads 72 integral therewith. The non-conductive spacers 68 should be located on the cathode head 22 in a manner that minimizes blockage of electrolyte flow over the cathode 66. For example, the helical pattern shown in FIG. 4 augments the mixing of the electrolyte without appreciably restricting the flow area of the electrolyte. Donut-shaped non-conductive spacers would tend to restrict or impede electrolyte flow and are therefor not preferred.

Non-conductive materials other than PTFE or glass-filled PTFE are suitable for use as spacers 68 with the present invention. However, PTFE and glass-filled PTFE are presently preferred because PTFE leaves no residue in the tubular product 28 and PTFE is inert to most electrolytes. Moreover, glass-filled PTFE is presently preferred because its enhanced strength decreases the likelihood that spacer material will be lost during use of the apparatus 10 and effectively mask certain portions of the tubular product 28.

A cathode head 22 made in accordance with the present invention is easily fabricated for various-sized tubular products, is readily installed and detached from the cathode rod 20, and has the potential to be a disposable item.

FIG. 5 depicts an end view of the tubular product 28 in which the cathode head 22 has been placed. It is seen that the non-conductive spacers 68 position the cathode 66 substantially about the center line of the tubular product 28.

Figure 6:
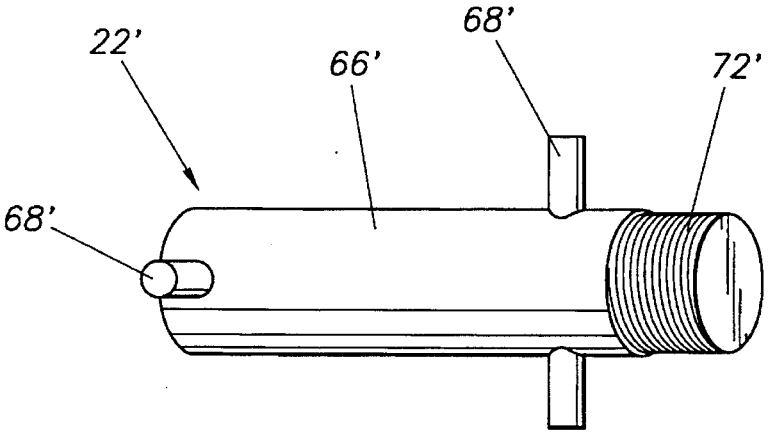
FIG. 6 illustrates a plan view of an alternative embodiment of a cathode head of the present invention.

FIG. 6 shows an alternate embodiment of the cathode head. The cathode head 22' is shown to comprise a cathode 66' and two sets of non-conductive spacers 68'. One set of spacers is located adjacent one end of the cathode head 22' and the second set of spacers is located at the opposite end of the cathode head 22 displaced 90° from the orientation of the first set of non-conductive spacers. The cathode head 22' also includes cathode threads 72' that are likewise adapted for mating engagement with the cathode rod 20.

Figure 7:
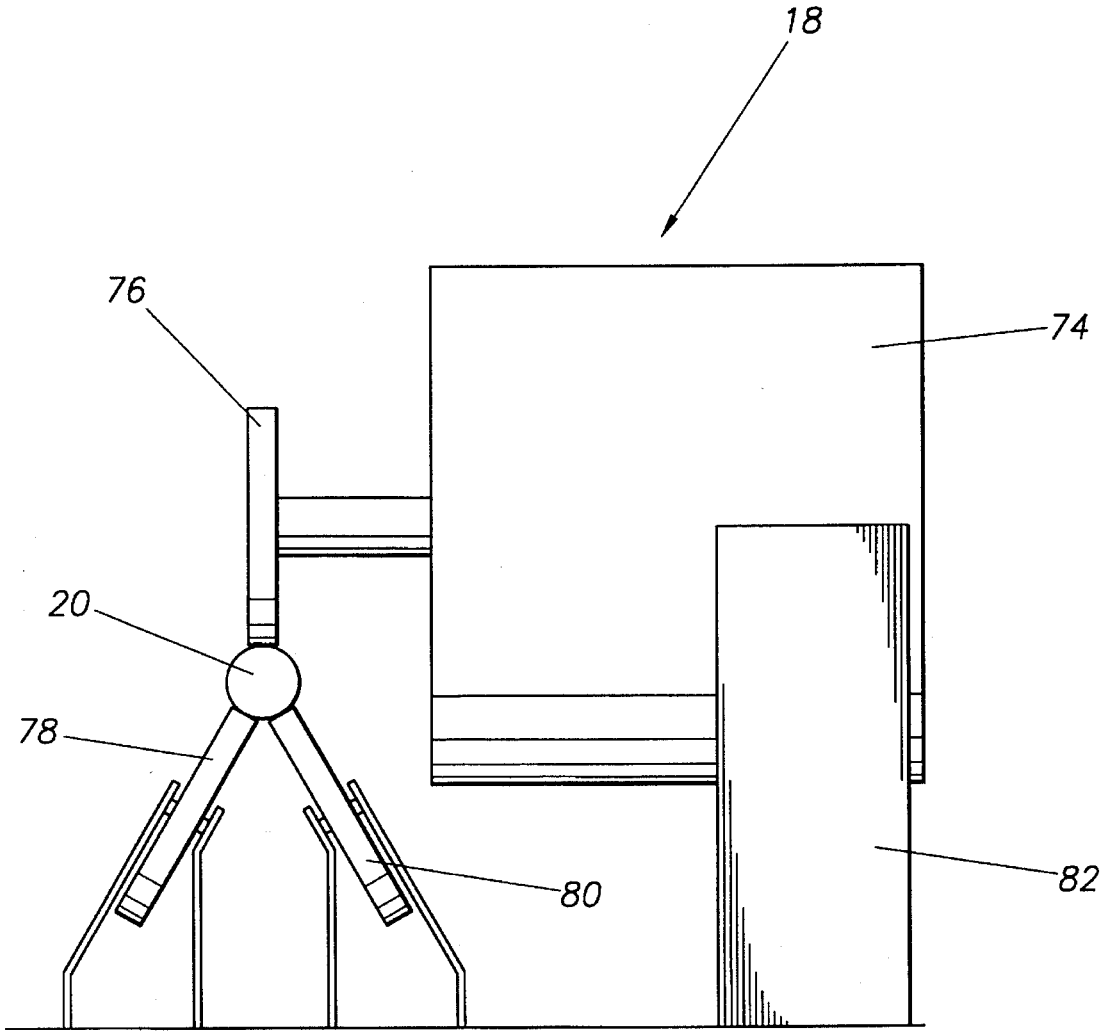
FIG. 7 illustrates an end view of the cathode rod drive assembly of the preferred embodiment.

Referring now to FIG. 7, the cathode rod drive assembly 18 is shown in more detail. The cathode rod drive assembly 18 is shown to comprise a drive unit 74, a drive wheel 76, idler wheels 78 and 80 and a drive unit support 82. Also shown in FIG. 7 is the cathode rod 20. In the preferred embodiment of the present invention, the drive unit 74 is a conventional stepper motor or DC brushless motor capable of incrementally controlling the angular rotation of the drive wheel 76. As shown in FIG. 7, the cathode rod 20 is pinched between the idler wheels 78 and 80 and the drive wheel 76. In response to electrical signals supplied to the drive unit 74, the drive wheel 76 can be made to rotate in either a clockwise or counterclockwise direction. Through friction, this angular rotation of the drive wheel 76 is converted into linear movement of the cathode rod 20. In the preferred embodiment, the drive unit supports 82 are adjustable to allow the drive wheel 76 and idler wheels 78 and 80 to accommodate cathode rods 20 of varying sizes. It will be appreciated that rotational displacement may be imparted to the cathode head 22 by angling the drive wheel 76 with respect to the longitudinal axis of the cathode rod 20. Rotational displacement may be imparted to the cathode head 22 by other means as well.

Figure 8:
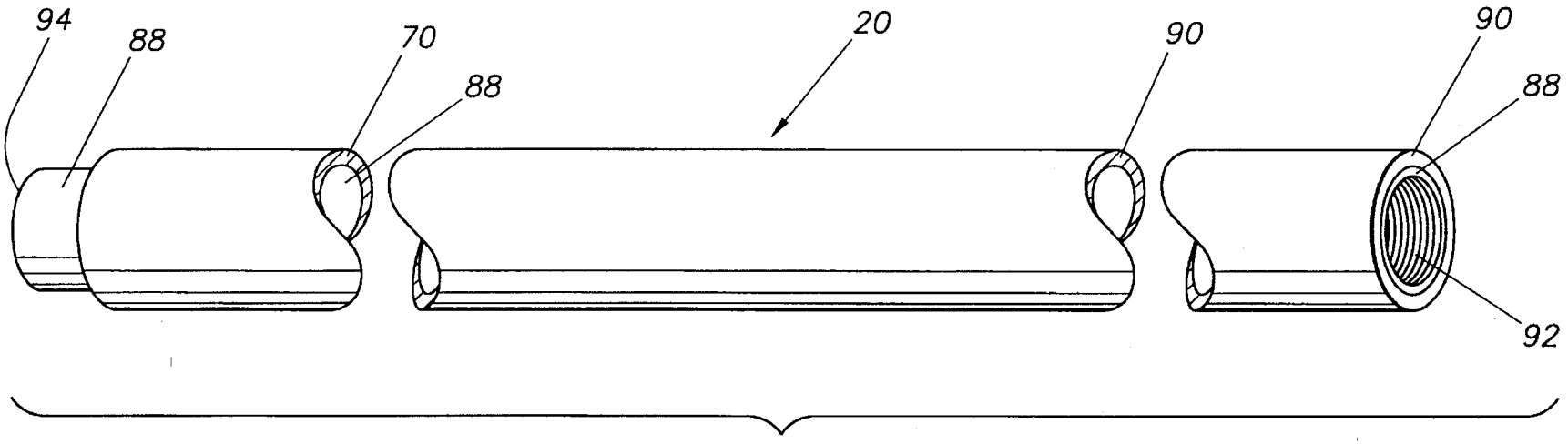
FIG. 8 illustrates a plan view of a cathode rod of the preferred embodiment.

FIG. 8 shows a preferred embodiment of the cathode rod 20. The cathode rod 20 is comprised of a central conductor 88 and a non-conductive outer insulation 90. The central conductor 88 can be fabricated from any number of conductors such as stainless steel, copper, carbon steel, alloy steel, aluminum, or graphite. Although it is presently preferred that the central conductor 88 be rigid and fabricated from a Beryllium-Copper alloy such as ASTM A172, the central conductor 88 of the cathode rod may also be a relatively flexible conductive wire. The outer insulation 90 may be any non-conductive or dielectric material suitable for insulating the negatively charged cathode rod 22 from the positively charged tubular product 28. It has been found that PVC heat shrink insulating tubing performs adequately as outer insulation. The outer insulation 90 should be relatively impervious to attack by the electrolyte. Also, the outer insulation 90 should provide a non-slip surface for drive wheel 76 to engage. The cathode rod 20 is also shown to comprise a threaded connection 92 and an electrical connection portion 94. The cathode head 22 (e.g., FIG. 4), and specifically the cathode threads 72, are adapted to mate with the threaded connection 92 and establish electrical communication between the central conductor 88 and the cathode 66. The electrical connection portion 94 provides a connection for a power supply lead 116.

Figure 9:
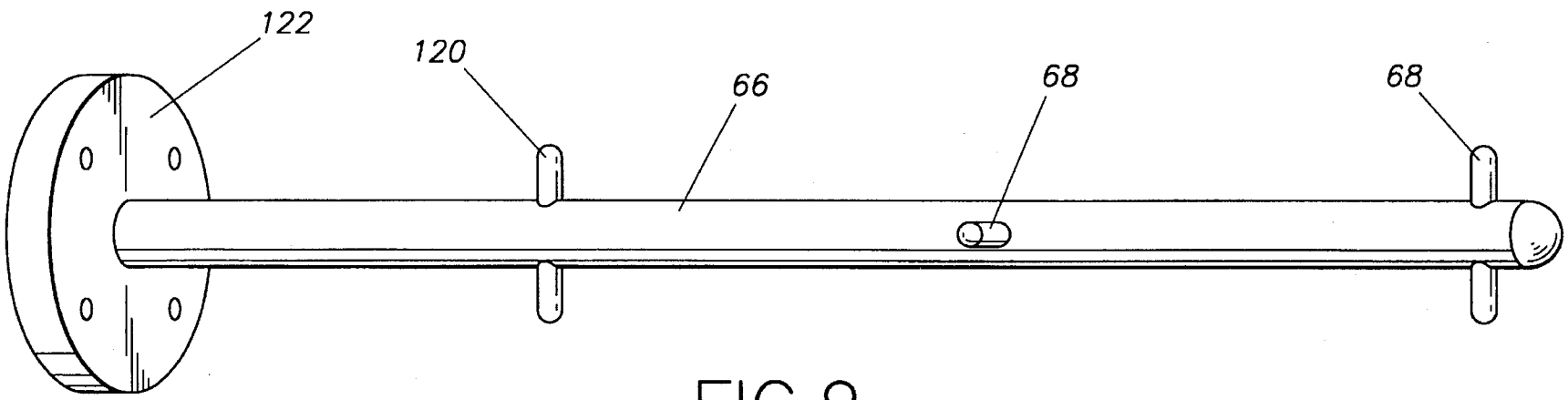
FIG. 9 illustrates a fixed cathode for use with the present invention.

It will be appreciated that the present invention may be utilized with a fixed cathode 120 that extends substantially the entire length of the tubular product 28. For example, as shown in FIG. 9, the cathode 120 is a preferably cylindrical rod fabricated from ASTM A172 Berrylium-Copper alloy. Non-conductive spacers 68 are located about cathode 120 and emanate radially therefrom to position the cathode 120 substantially along the centerline of the tubular product 28. Refering back to to FIG. 2, it will be appreciated that fixed cathode 120 may be inserted into the discharge reservoir 16 such that flange 122 replaces cathode rod seal 50 and fixed cathode 120 extends through discharge reservoir 16 and along the entire lenght (or whatever lenght is desired to be polished) of tubular product 28. Flange 122 has a connector (not shown) for connecting power supply lead 116 to cathode 120. Thus, the present invention is amenable for use with a fixed cathode or a moving cathode.

Referring again to FIG. 1, the electropolishing apparatus 10 also comprises a controller 86 and a power supply 84. The power supply 84 is preferably a conventional direct current power supply capable of supplying voltages of between 0 and 24 VDC. Depending upon the size of the tubular product 28, the power supply should be capable of producing between 0 and 3,000 amps and preferably between 0 and 150 amps. The controller 86 can be any of a number of conventional process controllers that include a microprocessor ($_{\mu}$P) having associated input, output and memory features, an analog-to-digital conversion unit (ADC) and a digital-to-analog conversion unit (DAC). Alteratively, the controller 86 may also be a conventional personal computer, for which after-market analog-to-digital conversion cards and digital-to-analog conversion cards are available. The controller 86 can be programmed and configured to monitor and control the power supply 86, the drive assembly 18, the electrolyte pump 32 and the electrolyte reservoir 30.

A preferred use of the electropolishing apparatus 10 will now be described to further illustrate the novel features of the present invention. Depending on the size and length of the tubular product 28, the cathode rod 20 and the cathode head 22 are selected. The cathode rod 20 is selected to be of sufficient size to carry the amount of current needed to electrolytically polish the inside diameter surface of the tubular product 28 without restricting the annular flow region between the cathode rod 20 and the inside diameter surface of tubular product 28. The cathode head 22 is selected according to similar criteria and in addition, should have non-conductive spacer members 68 of sufficient size and distribution to align the cathode 66 substantially along the center line of the tubular product 28. For example, if the tubular product is a 24 inch length of 30 caliber (0.300" dia.) rifle stock, the cathode rod 22 is preferably a 36 inch length of ASTM A172 Beryllium-Copper alloy. The cathode head 22 is fabricated as shown in FIG. 4 from about 10 gauge copper wire. PTFE strips approximately 0.125" in thickness are forced into the interstices formed by twisting the 10 gauge copper wire about itself. The ends of the PTFE spacers can be sanded, fried, or otherwise machined to the proper size for use in the 30 caliber rifle stock. The overall length of the cathode head 22 is approximately 2 inches.

Once the selection of the cathode head 22 has been made, the corresponding discharge reservoir 16 and entrance reservoir 24 are also selected according to the requirements discussed previously. Once these items are selected, the reservoirs 16 and 24 are installed on the seal blocks 14 and 26, respectively. Thereafter, the cathode rod 20 is installed between the drive wheel 76 and the idler wheels 78 and 80 as shown in FIG. 7. The drive unit 18 can be used to feed the cathode rod 20 through the cathode rod seal 50 in the discharge reservoir 16. The cathode rod 20 is extended past the discharge seal block 14 so that the cathode head 22 may be installed on the cathode rod 20.

After the cathode head 22 has been installed, the cathode drive unit 18 is used to retract the cathode head 22 into the discharge reservoir 16. The discharge seal 42 is placed in the recessed sealing surface 40. The tubular product 28, e.g., the 24 inch length of 30 caliber rifle stock, is placed on the tubular product supports 12 and the supports 12 are adjusted so that the center line of the tubular product 28 substantially coincides with the center line of the cathode head 22 and the cathode rod 20. The end of the tubular product 28 adjacent the discharge seal 42 is brought into contact with the exposed surface of the discharge seal 42. The entrance seal 64 is positioned in the entrance sealing surface 60 of the entrance reservoir 24 and the entrance sealing block 26 is adjusted so that the exposed surface of the entrance seal 64 engages the exposed end surface of the tubular product 28. Further, the entrance sealing block 26 is forced against the tubular product 28 such that a fluid-tight seal is achieved between the entrance seal 64 and the tubular product 28 and between the tubular product 28 and the discharge seal 42. The entrance seal block 26 is locked into fluid-tight position. The electrolyte supply line 34 is connected to the entrance seal block 26 and the electrolyte return line 36 is connected to the discharge reservoir 16.

Next, the drive unit 18 can be used to extend the cathode head 22 through the tubular product 28 into the entrance reservoir 24. It will be appreciated that the position of the cathode head 22 in the entrance reservoir can be detected by several methods. For example, the cathode head 22 can have a tip (not shown) adapted to engage or occlude threaded connection 56. As the cathode head 22 approaches the threaded connection 56, the pressure of the electrolyte fluid in supply line 34 will increase sharply. This detection methodology can be used to "zero" the cathode head 22 the apparatus 10. Alternatively, contact of the cathode 66 with threaded connection 56 or some other conductive portion of the entrance reservoir can be detected electrically. The electrolyte supply line 34 is connected in fluid communication with the entrance reservoir 24 through the entrance seal block 26. The electrolyte return line 36 is likewise connected in fluid communication between the discharge reservoir 16 and the electrolyte reservoir 30. It has been found for carbon steel and alloy steel based tubular products that an electrolyte comprising 10% to 16% chromic acid ($CrO_3$) and 90% to 84% phosphoric acid ($H_3PO_4$) by volume is preferred. The chromic acid is preferably greater than 99% pure and the phosphoric acid is technical grade (also known as orthophosphoric acid, 1.69 s.g.). For stainless steel based tubular products (e.g., AISI 300 and 400 series) an electrolyte comprising about 25% sulfuric acid ($H_2SO_4$) and 75% phosphoric acid ($H_3PO_4$) by volume is preferred. It will be appreciated that other electrolytes may be used with the present invention. It will also be appreciated that the present invention can be used with tubular products based on other material systems. For example, titanium tubular products are amenable to electropolishing by the present invention using an electrolyte solution of 400 grams/liter of chromic acid ($CrO_3$) and 160 ml/liter of hydrofluoric acid (HF). A 16% chromic, 84% phosphoric acid electrolyte was used with the 24 inch length of 30 caliber alloy steel rifle stock.

Once the appropriate electrolyte has been chosen and a tubular product 28 is in fluid tight communication with the entrance reservoir 24 and the discharge reservoir 16, the electrolyte pump 32 may be engaged to supply a steady state flow of electrolyte past the cathode head 22 and through the tubular product 28. It has been found that an electrolyte flow rate of approximately one gallon per minute is preferred when using the present invention with 30 caliber rifle stock made from carbon steel. Acceptable flow rates for the present invention are thought to range between 0.1 gallons per minute and 10 gallons per minute. Other electrolyte flow rates may be acceptable depending upon the size of the tubular product 28, the material system of the tubular product 28, the density and efficiency of electrolytic dissolution and other factors. It has been found that the electrolyte must be continuously mixed or agitated as it flows through the tubular product being polished. This allows the gases that are produced during electrolytic dissolution to be removed or displaced from the surfaces undergoing ionic transfer. The flow rate of the electrolyte, the displacement of the cathode head 22, the rotation, if any, of the cathode head 22, and the placement of the non-conductive spacers 68 (e.g., the helical pattern of FIG. 4), affect the mixing or agitation of the electrolyte and, hence, affect the efficiency of the polishing process.

As shown in FIG. 1, the electrolyte pump 32 has associated therewith a control line 96. The control line 96 provides controller 86 control and monitoring data on the electrolyte pump 32. The controller 86 can use the control line 96 (or multiple control lines) to monitor the flow rate of electrolyte produced by the pump 32 and to control the flow rate at a predetermined level. Also shown in FIG. 1 is a control line 98 connecting the electrolyte reservoir 30 with the controller 86. The control line 98 (or multiple control lines) are used to control and monitor various properties of the electrolyte in the reservoir 30. Preferably, the control line 98 is used to monitor the temperature of the electrolyte in the electrolyte reservoir 30. By energizing or de-energizing a heater (not shown), controller 86 can utilize the control line 98 to control the temperature of the electrolyte in the reservoir 30 at a predetermined level. Also, the control line 98 can be used in conjunction with an appropriate sensor (not shown) to monitor the metal ion content of the electrolyte. It will be appreciated that the controller 86 can be used to monitor other characteristics or properties of the electrolyte, such as specific gravity, $H_2O$ content, or acid content, and/or the electrolyte reservoir 30. It has been found for carbon steel and alloy steel based material systems that the electrolyte temperature (preferably, 16% chromic, 84% phosphoric) should be maintained at approximately 150° F. Temperature control of approximately ±10° F. is preferred. For stainless steel based material systems, it is preferable to maintain the electrolyte temperature at approximately 200° F. ±10° F. It will be appreciated that additional temperature sensors may be located at positions other than or in addition to the electrolyte reservoir 30. For example, a temperature sensor may be located in the entrance reservoir 24 and a temperature sensor may be located in the discharge reservoir 16. Also, a temperature sensor may be located on or near the cathode head 22. In such an installation, care must be taken to insulate the temperature sensor from the heat generated by the cathode 66 so that only the temperature of the electrolyte is measured. Temperature sensors at these locations may provide greater control over the actual electrolyte temperature that flows through the tubular product 28. In addition, it will be appreciated that the entrance reservoir 24 and/or the discharge reservoir 16 may be artificially heated to maintain the electrolyte at the desired temperature. Also, the current supplied to the cathode 66 can be adjusted to increase or decrease the heating supplied to the electrolyte by the cathode 66.

After the appropriate electrolyte has reached a predetermined temperature and flow rate through the tubular product 28, the electric potential can be established between the cathode head 22 and the tubular product via leads 116 and 118, respectively. It has been found for carbon or alloy steel based tubular products, such as firearm barrels, that voltages in the range of 4–12 VDC are preferable. For stainless steel based tubular products, it has been found that voltages in the range of 12–18 VDC are preferable. It has also been found that perhaps the most important criteria involved in successful use of the present invention is the current density at which the present invention operates. The current density must be sufficient to achieve the desired amount of electrolytic dissolution or polishing in a reasonable amount of time without over polishing the tubular product. Typically, current densities of between 1 and 5 amp-min/square inch are preferred. For example, the 30 caliber rifle stock was polished in a single pass operation from the entrance reservoir 24 to the discharge reservoir 16 at a current density of approximately 3.18 amp-min/square inch. More specifically, the power supply 84 supplied approximately 10 amps at 4 VDC for a period of 8 minutes while traversing the 24-inch piece of rifle stock.

As shown in FIG. 1, a power supply control line 100 allows the controller 86 to monitor and control the power supply based upon output voltage, output current, or both. It will be appreciated that for a variety of reasons, the electrical resistance experienced by the cathode head 22 as it traverses the tubular product 28 may vary along the length of the tubular product 28. The controller 86 can be programmed in a known manner to maintain either voltage, current, or both despite these changes in resistance. Moreover, it will be appreciated that the controller 86 can be used to control the power supply 84 to provide a "dynamic" voltage or current profile to the cathode head 22. For example, the current density supplied to the cathode head 22 can be increased or decreased with respect to its position along the tubular product 28 in order to induce a polished taper into the tubular product 28, or to remove dimensional irregularities, e.g., tight spots. Alternatively, a profile of the tubular product can be programmed into the controller 86 to achieve the same result.

Referring again to FIG. 1, a drive assembly control line 102 allows the controller 86 to control the linear velocity of the cathode head 22 through the tubular product 28. The cathode drive assembly 18 can be energized to push or pull the cathode head 22 through the tubular product 28 at a controlled steady-state velocity, or the cathode drive assembly 18 can be energized to push or pull the cathode head 22 at a velocity that changes with time. It is preferred to displace the cathode head 22 in the direction of electrolyte flow. However, the present invention is advantageous with bi-directional displacement and with displacement against the flow of electrolyte. While the controller 86 plays an integral role in the preferred embodiment of the present invention, it will be appreciated that the present invention can be practiced without a controller. For example, conventional power supplies are available that have sufficient control facilities therein to provide a relatively constant voltage and/or relatively constant current. Further, conventional pumps are available to provide a predetermined flow rate of electrolyte. Similarly, the other components of the present invention can be autonomous from one another.

Figure 10:
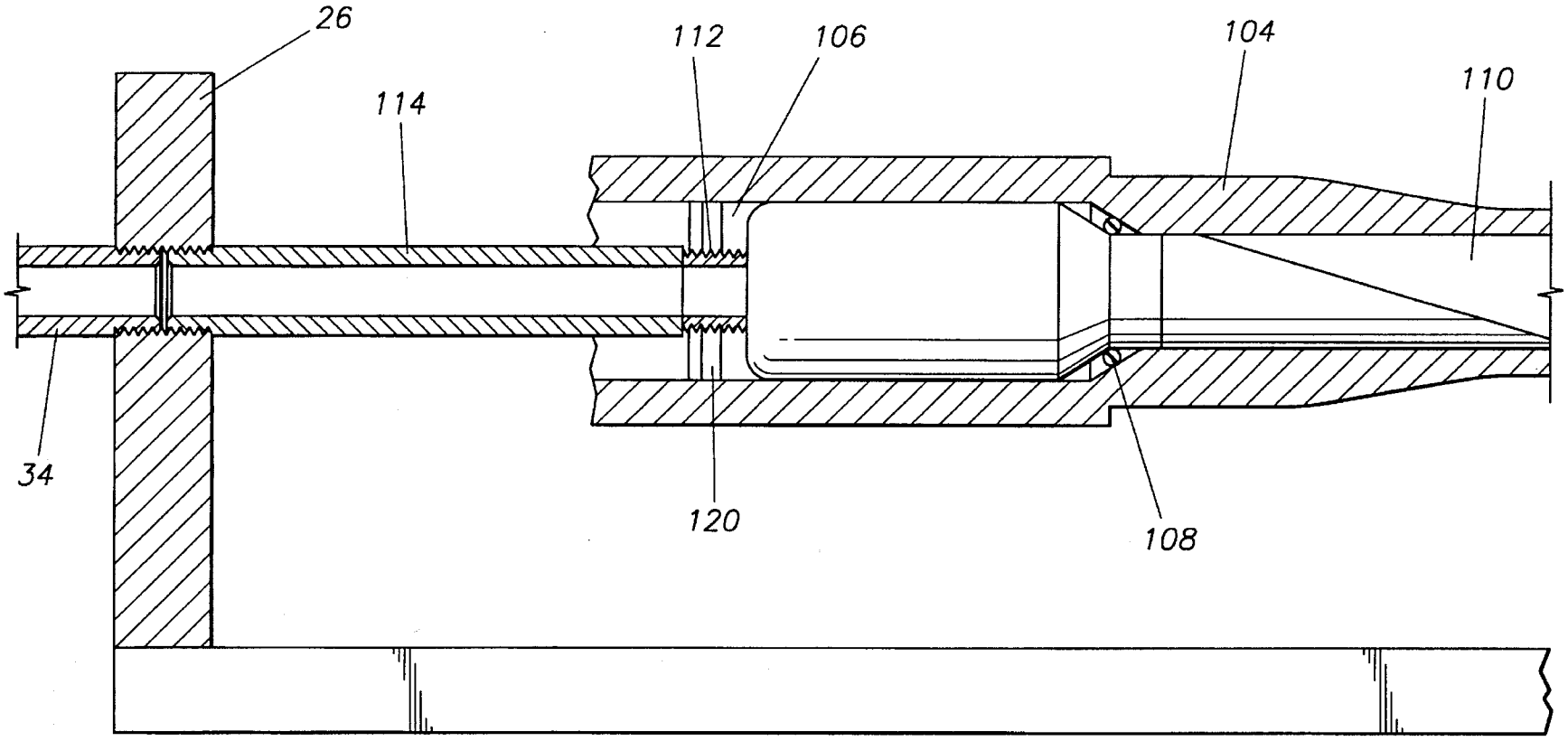
FIG. 10 illustrates a cross-sectional view of a firearm barrel with a preferred entrance reservoir of the present invention.

An alternative preferred embodiment is shown in FIG. 10. The present invention is also useful for electrolytically polishing the inside diameter surface of completed firearm or artillery barrels. However, completed barrels offer complexities not associated with electrolytic polishing of rifle stock. As shown in FIG. 10, the preferred embodiment of the present invention for electrolytically polishing a finished firearm barrel 104 comprises the use of a conventional cartridge casing 106 as the entrance reservoir of the present invention. It has been found that positioning an elastomeric "O" ring 108 around the outside surface of the cartridge 106 as shown in FIG. 10, will provide a fluid-tight seal with rifle chamber 110. Placement of the "O" ring 108 can be varied depending upon size and shape of cartridge 106, size and shape of the cartridge receiving section of the barrel 104 and other variables. For example, a groove can be machined into the body of the cartridge casing 106 to receive seal 108. Alternatively, the seal 108 can be placed in the ejector ring 120. It is preferred that the fluid-tight seal be formed as closely adjacent the rifled chamber portion of the barrel 104 as practical. In the electrolytic polishing of a finished firearm barrel 104, it is extremely important not to allow the electrolyte to contact or affect any portion of the firearm or barrel 104 that is not to be polished. For example, many firearm owners do not want the cartridge receiving area to be enlarged or polished.

As shown in FIG. 10, the cartridge casing 106 is adapted as an entrance reservoir by drilling and tapping a supply line connection 112. A cartridge supply line 114 is adapted to connect the electrolyte supply line to cartridge casing 106 through entrance seal block 26. It will be appreciated that the cartridge connection 112 is selected to allow sufficient flow rate of electrolyte through the barrel 104. Use of the present invention with a finished firearm barrel 104 is similar in all other respects to that description given above with respect to any other tubular product.

One advantage of the present invention is that it allows barrels of all shapes and sizes to be electrolytically polished by the same apparatus. Additionally, the present invention is amenable to production-type electropolishing of multiple tubular products at one time.

The foregoing disclosure is sufficient to enable one of ordinary skill in the art to practice the present invention. Further, this foregoing disclosure provides the best mode of practicing the present invention presently contemplated by the inventors. However, it will be appreciated by those of ordinary skill in the art having benefit of this disclosure that there are various modifications that may be made to the above disclosure without departing from the scope of the present invention.

What is claimed is:

1. An apparatus, comprising:

a first reservoir, a second reservoir spaced apart from said first reservoir, said second reservoir in fluid communication with said first reservoir when a tubular product is placed between said reservoirs;

a cathode head comprising a conductor portion and a non-conductor portion, said cathode head adapted to reside in said first reservoir and second reservoir as said cathode head extends beyond an end of said tubular product, said cathode head further adapted to travel along an inside surface of said tubular product with only said non-conductor portion engaging said tubular product;

a cathode rod comprising a conductor portion and a non-conductor portion with each portion extending substantially the length of said rod, said conductor portion of said cathode rod adapted for mating engagement with said conductor portion of said cathode head;

an electrolyte supply system for supplying an electrolyte at a predetermined flow rate, said system supplying electrolyte to said first reservoir and retrieving electrolyte from said second reservoir;

a drive assembly for displacing said cathode head from either of said first or second reservoirs and along said inside surface of said tubular product at a predetermined rate; and a power supply for establishing an electric potential between said cathode head and said tubular product whereby ionic transfer is accomplished between said inside surface of said tubular product in the presence of flowing electrolyte.

2. The apparatus of claim 1, wherein said tubular product is a barrel.

3. The apparatus of claim 1, wherein said tubular product is barrel stock.

4. The apparatus of claim 1, wherein said power supply supplies a direct current voltage between 1 and 20 vdc and a direct current between 1 and 20 amps.

5. The apparatus of claim 1, wherein said drive assembly is adapted to displace said cathode head at a rate between 1 inch per minute and 20 inches per minute.

6. The apparatus of claim 1, wherein said electrolyte supply system is adapted to supply electrolyte at a flow rate of between 0.1 and 10 gallons per minute.

7. The apparatus of claim 1, wherein said tubular product is made from stainless steel, and wherein said electrolyte is 25% sulfuric acid and 75% phosphoric acid.

8. The apparatus of claim 1, wherein said power supply and said drive assembly are adapted to provide said cathode head with a current density of between 1 and 10 amp-min/sq. in.

9. An apparatus, comprising:

a first reservoir, a second reservoir spaced apart from said first reservoir, said second reservoir in fluid communication with said first reservoir when a tubular product is placed between said reservoirs:

a cathode head comprising a conductor portion and a non-conductor portion, said cathode head adapted to reside in said first reservoir and said second reservoir, said cathode head further adapted to travel along an inside surface of said tubular product with only said non-conductor portion engaging said tubular product;

a cathode rod comprising a conductor portion and a non-conductor portion with each portion extending substantially the length of mid rod, said conductor portion of said cathode rod adapted for mating engagement with said conductor portion of said cathode head;

an electrolyte supply system for supplying an electrolyte at a predetermined flow rate, said system supplying electrolyte to said first reservoir and retrieving electrolyte from said second reservoir;

a drive assembly for displacing said cathode head from either of said first or second reservoirs and along said inside surface of said tubular product at a predetermined rate; and a power supply for establishing an electric potential between said cathode head and said tubular product whereby ionic transfer is accomplished between said inside surface of said tubular product in the presence of flowing electrolyte, wherein said tubular product is a barrel, and wherein said first reservoir is a cartridge casing adapted to form a fluid-tight seal with a portion of said barrel.

10. The apparatus of claim 9, further comprising a seal between said cartridge casing and said barrel for preventing the escape of electrolyte.

11. An apparatus comprising:

a first reservoir, a second reservoir spaced apart from said first reservoir, said second reservoir in fluid communication with said first reservoir when a tubular product is placed between said reservoirs;

a cathode head comprising a conductor portion and a non-conductor portion, said cathode head adapted to reside in said first reservoir and said second reservoir, said cathode head further adapted to travel along an inside surface of said tubular product with only said non-conductor portion engaging said tubular product;

a cathode rod comprising a conductor portion and a non-conductor portion with each portion extending substantially the length of said rod, said conductor portion of said cathode rod adapted for mating engagement with said conductor portion of said cathode head;

an electrolyte supply system for supplying an electrolyte at a predetermined flow rate, said system supplying electrolyte to said first reservoir and retrieving electrolyte from said second reservoir:

a drive assembly for displacing said cathode head from either of said first or second reservoirs and along said inside surface of said tubular product at a predetermined rate; and a power supply for establishing an electric potential between said cathode head and said tubular product whereby ionic transfer is accomplished between said inside surface of said tubular product in the presence of flowing electrolyte, wherein said cathode head further comprises:

a central portion comprising an electrically conductive substantially cylindrical rod twisted about itself;

a plurality of non-conductive spacers emanating substantially radially from said central portion, said spacers arranged such that electrolyte flow over said central portion is not substantially restricted;

an electrical connection into which said central portion terminates, said connection adapted to withstand stresses associated with pushing or pulling said cathode head along said inside surface of said tubular product and adapted to withstand conduction of electricity associated with electrolytic polishing of said inside surface.

12. The apparatus of claim 1, wherein said tubular product is made from carbon steel, and wherein said electrolyte is between 10% and 16% chromic acid and between 90% and 84% phosphoric acid.

13. The apparatus of claim 11, wherein:

said tubular product is a barrel, said electrolyte is between 10% and 16% sulfuric acid and between 90% and 84% phosphoric acid; and said power supply and said drive assembly are adapted to provide said cathode head with a current density of between 3 and 4 amp-min/sq. in.

14. A computer-controlled electrolytic polishing apparatus, comprising:

a first reservoir having a substantially cylindrical chamber with an entrance and an exit;

a second reservoir having a substantially cylindrical chamber with an entrance and an exit, said second reservoir separated from said first reservoir by a distance, said second reservoir in fluid communication with said first reservoir when a tubular product is placed between said exit of said first reservoir and said entrance of said second reservoir;

a cathode head comprising a conductor portion and a non-conductor portion, said cathode head adapted to reside in said first reservoir and second reservoir, said cathode head further adapted to travel along an inside surface of said tubular product with only said non-conductor portions engaging said tubular product;

an electrolyte supply system for supplying an electrolyte at a predetermined flow rate and temperature, said system supplying electrolyte to said first reservoir and retrieving electrolyte from said second reservoir;

a drive assembly for displacing said cathode head from either of said first or second reservoirs and along said inside surface of said tubular product at a predetermined rate;

a power supply for establishing an electric potential between said cathode head and said tubular product whereby ionic transfer is accomplished between said inside surface of said tubular product in the presence of flowing electrolyte; and a microprocessor system adapted to monitor and control the rate at which said drive assembly displaces said cathode head, to monitor and control the flow rate and temperature of said electrolyte in said electrolyte supply system, to monitor and control said power supply, in accordance with programming for electrolytic polishing of said tubular product.

15. The apparatus of claim 14, wherein said tubular product is a barrel.

16. The apparatus of claim 15, wherein said first reservoir is a cartridge casing adapted to form a fluid-tight seal with a portion of said barrel.

17. The apparatus of claim 16, further comprising a seal between said cartridge casing and said barrel for preventing the escape of electrolyte.

18. The apparatus of claim 14, wherein said tubular product is barrel stock.

19. The apparatus of claim 14, wherein said power supply supplies a direct current voltage between 1 and 20 vdc and a direct current between 1 and 20 amps.

20. The apparatus of claim 14, wherein said drive assembly is adapted to displace said cathode head at a rate between 1 inch per minute and 20 inches per minute.

21. The apparatus of claim 14, wherein said electrolyte supply system is adapted to supply electrolyte at a flow rate of between 0.1 and 10 gallons per minute.

22. The apparatus of claim 14, wherein said cathode head further comprises:

a central portion comprising an electrically conductive substantially cylindrical rod twisted about itself;

a plurality of non-conductive spacers emanating substantially radially from said central portion, said spacers arranged such that electrolyte flow over said central portion is not substantially restricted;

an electrical connection into which said central portion terminates, said connection adapted to withstand stresses associated with pushing or pulling said cathode head along said inside surface of said tubular product and adapted to withstand conduction of electricity associated with electrolytic polishing of said inside surface.

23. The apparatus of claim 14, wherein said tubular product is made from carbon steel, and wherein said electrolyte is between 10% and 16% chromic acid and between 90% and 84% phosphoric acid.

24. The apparatus of claim 14, wherein said tubular product is made from stainless steel, and wherein said electrolyte is 25% sulfuric acid and 75% phosphoric acid.

25. The apparatus of claim 14, wherein said power supply and said drive assembly are adapted to provide said cathode head with a current density of between 1 and 10 amp-min/sq. in.

26. The apparatus of claim 14, wherein:

said tubular product is a barrel, said cathode head further comprises:

a central portion comprising an electrically conductive substantially cylindrical rod twisted about itself;

a plurality of non-conductive spacers emanating substantially radially from said central portion, said spacers arranged such that electrolyte flow over said central portion is not substantially restricted;

an electrical connection into which said central portion terminates, said connection adapted to withstand stresses associated with pushing or pulling said cathode head along said inside surface of said tubular product and adapted to withstand conduction of electricity associated with electrolytic polishing of said inside surface, said electrolyte is 25% sulfuric acid and 75% phosphoric acid; and said power supply and said drive assembly are adapted to provide said cathode head with a current density of between 3 and 4 amp-min/sq. in.

27. A cathode head for electrolytic polishing, comprising:

a central portion comprising an electrically conductive substantially cylindrical rod twisted about itself;

a plurality of non-conductive spacers emanating substantially radially from said central portion, said spacers arranged such that fluid flow over said central portion is not substantially restricted;

an electrical connection into which said central portion terminates, said connection adapted to withstand stresses associated with pushing or pulling said cathode head and adapted to withstand conduction of electricity associated with said electrolytic polishing.

28. A method for electrolytically polishing an inside surface of a tubular product, which comprises the steps of:

placing a cathode head inside a first reservoir located adjacent one end of said tubular product, said cathode head extending beyond said end of said tubular product;

providing a second reservoir located adjacent another end of said tubular product, said first reservoir, said tubular product, and said second reservoir in fluid communication;

flowing an electrolyte through said first reservoir, said tubular product and said second reservoir, and over said cathode head;

establishing an electric potential between said tubular product and cathode head;

displacing said cathode head from said first reservoir along the length of said tubular product; and causing ionic displacement between said tubular product and said cathode head.

29. An apparatus, comprising:

a cathode head comprising a conductor portion and a non-conductor portion, said cathode head adapted to travel along an inside surface of a tubular product with only said non-conductor portion engaging said tubular product;

a cathode rod comprising a conductor portion and a non-conductor portion with each portion extending substantially the length of said rod, said conductor portion of said cathode rod adapted for mating engagement with said conductor portion of said cathode head;

first and second reservoirs spaced apart from each other, said reservoirs in fluid communication with each other when said tubular product is placed between said reservoirs, each of said reservoirs adapted to receive said cathode head as said cathode head extends beyond an end of said tubular product;

an electrolyte supply system for supplying an electrolyte at a predetermined flow rate, said system supplying electrolyte to said first reservoir and retrieving electrolyte from said second reservoir;

a drive assembly for displacing said cathode head from either of said first or second reservoirs and along said inside surface of said tubular product at a predetermined rate; and a power supply for establishing an electric potential between said cathode head and said tubular product whereby ionic transfer is accomplished between said inside surface of said tubular product in the presence of flowing electrolyte.

* * * * *

UNITED STATES PATENT AND TRADEMARK OFFICE

CERTIFICATE OF CORRECTION

PATENT NO. : 5,507,923

DATED : April 16, 1996

INVENTOR(S) : Henry J. Stouse et al

It is certified that error appears in the above-indentified patent and that said Letters Patent is hereby corrected as shown below:

Title page, item [76], add --Arnold A. Sturm, 16215 Clay Road, No. 306, Houston, Texas, 77084-- to the list of inventors.

Signed and Sealed this

Twenty-fourth Day of December, 1996

*Attest:*

Bruce Lehman

BRUCE LEHMAN

*Attesting Officer*

*Commissioner of Patents and Trademarks*